US010390643B2

(12) United States Patent
Anderl

(10) Patent No.: US 10,390,643 B2
(45) Date of Patent: Aug. 27, 2019

(54) REFILLABLE DESIGN FOR A CLOSED WATER BOTTLE

(71) Applicant: International Business Machines Corporation, Armonk, NY (US)

(72) Inventor: William J. Anderl, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 129 days.

(21) Appl. No.: 15/473,218

(22) Filed: Mar. 29, 2017

(65) Prior Publication Data

US 2018/0282030 A1 Oct. 4, 2018

(51) Int. Cl.

| | |
|---|---|
| ***A47G 19/22*** | (2006.01) |
| ***A47G 21/18*** | (2006.01) |
| ***B65D 25/28*** | (2006.01) |
| ***B65D 47/20*** | (2006.01) |

(52) U.S. Cl.

CPC ..... *A47G 21/18* (2013.01); *A47G 19/2266* (2013.01); *B65D 25/28* (2013.01); *B65D 47/2012* (2013.01); *B65D 47/2031* (2013.01); *B65D 2525/282* (2013.01)

(58) Field of Classification Search

CPC .... B65D 47/00; B65D 25/28; B65D 43/0225; B65D 47/065; B65D 43/26; B65D 2525/28; B65D 2547/063; A47G 21/18

USPC .. 220/714, 715, 367.1, 203.04, 203.24, 231; 137/522, 523; 215/309

See application file for complete search history.

(56) References Cited

U.S. PATENT DOCUMENTS

| | | | | |
|---|---|---|---|---|
| 1,525,032 | A * | 2/1925 | Grady | B65D 47/248 137/862 |
| 3,739,938 | A * | 6/1973 | Paz | A47G 19/2272 215/309 |
| 5,048,705 | A | 9/1991 | Lynd et al. | |
| 5,343,889 | A * | 9/1994 | Jaw | F16K 15/202 137/232 |
| 5,597,087 | A | 1/1997 | Vinarsky | |
| 6,164,314 | A * | 12/2000 | Saputo | F16K 15/202 137/232 |
| 8,602,278 | B2 | 12/2013 | Sweigart | |
| 9,149,808 | B1 | 10/2015 | Smith et al. | |
| 2003/0145888 | A1* | 8/2003 | Lin | A43B 13/203 137/223 |
| 2006/0226110 | A1* | 10/2006 | Choi | A47G 19/2266 215/228 |
| 2009/0014072 | A1* | 1/2009 | Zhang | A47C 27/081 137/522 |
| 2011/0011908 | A1 | 1/2011 | Dietterle et al. | |

(Continued)

FOREIGN PATENT DOCUMENTS

| | | | |
|---|---|---|---|
| CN | 202760480 | U | 3/2013 |
| TW | I345454 | B | 7/2011 |
| WO | 2010044068 | A1 | 4/2010 |

*Primary Examiner* — James N Smalley

(74) *Attorney, Agent, or Firm* — Patterson + Sheridan, LLP

(57) ABSTRACT

Aspects of the disclosure generally relate to lids for water bottles and water bottles having the same. The lid includes a lid body, a mouth piece coupled to the lid body, and a valve formed in the lid body. The valve is actuatable to selectively allow fluid flow therethrough. The disclosed water bottles include the preceding lid. The disclosed water bottles can be filled with a fluid without removing a lid from the water bottles.

15 Claims, 5 Drawing Sheets

(56) References Cited

U.S. PATENT DOCUMENTS

| | | | |
|---|---|---|---|
| 2016/0031721 | A1 | 2/2016 | Kellam et al. |
| 2016/0046420 | A1 | 2/2016 | Wu |

* cited by examiner

REFILLABLE DESIGN FOR A CLOSED WATER BOTTLE

BACKGROUND

Field

The present disclosure generally relates to water bottles, and more particularly, water bottles which can be filled with a lid on the water bottle.

Description of the Related Art

Refillable water bottles are increasing in popularity as more people become environmentally conscious. Conventional refillable water bottles include a removable lid, which is generally removed with one hand while the bottle is grasped with another. Thus, refilling conventional water bottles typically requires the use of both hands. Additionally, some conventional water bottles may include a lid with a flip top. While these water bottles may be filled through the flip top, these water bottles are difficult to drink from, and my result in spilled or dribbled liquid during consumption.

What is needed is an improved lid for a water bottle that facilitates easier and quicker refilling.

SUMMARY

According to one embodiment of the present disclosure, a lid for a water bottle is provided. The lid comprises a lid body having an upper surface and a lower surface; a mouthpiece coupled to the upper surface of the lid body; and a valve formed in the lid body and laterally spaced form the mouthpiece, the valve extending below the lower surface and comprising a flapper actuatable to selectively allow fluid flow therethrough.

In another embodiment, a water bottle is provided. The water bottle comprises a container body; and a lid configured to be secured to the container body. The lid comprises a lid body; a mouthpiece coupled to the upper surface of the lid body having an upper surface and a lower surface; and a valve formed in the lid body and laterally spaced from the mouthpiece, the valve extending below the lower surface and comprising a flapper actuatable to selectively allow fluid flow therethrough.

In another embodiment, a water bottle is provided. The water bottle comprises a container body; and a lid configured to be secured to the container body by a threaded connection. The lid comprises a lid body; a mouthpiece coupled to the lid body; a valve formed in the lid body and laterally spaced from the mouthpiece, the valve actuatable to selectively allow fluid flow therethrough when engaged by a fluid source; and a straw coupled to the mouthpiece and extendable into the container body when the lid is secured to the container body.

BRIEF DESCRIPTION OF THE SEVERAL VIEWS OF THE DRAWINGS

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the disclosure" shall not be construed as a generalization of any inventive subject matter disclosed herein and shall not be considered to be an element or limitation of the appended claims except where explicitly recited in a claim(s).

Aspects of the disclosure generally relate to lids for water bottles and water bottles having the same. The lid includes a lid body, a mouth piece coupled to the lid body, and a valve formed in the lid body. The valve is actuatable to selectively allow fluid flow therethrough. The disclosed water bottles include the preceding lid. The disclosed water bottles can be filled with a fluid without removing a lid from the water bottles.

Figure 1A:
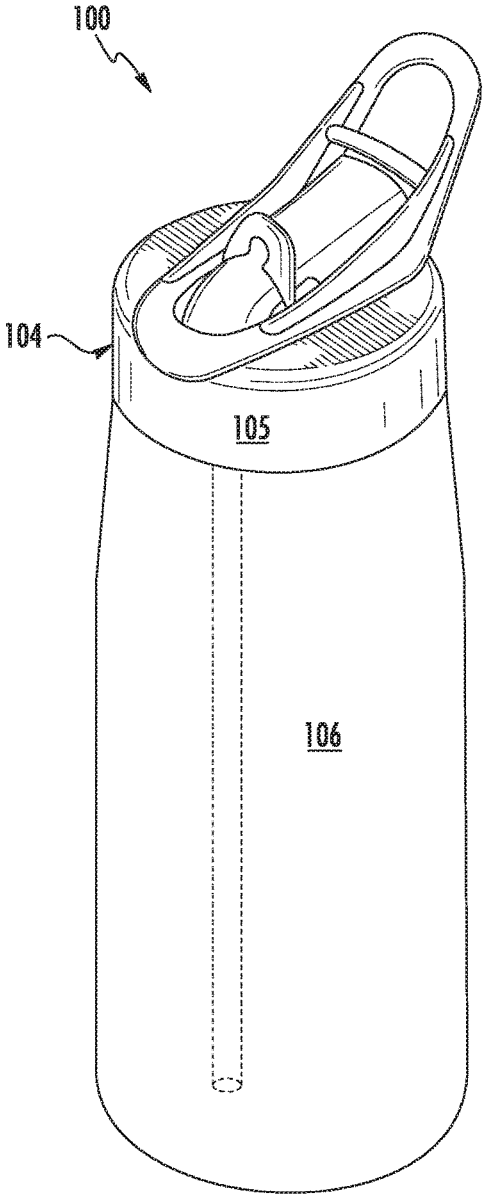
FIGS. 1A and 1B are schematic perspective views of a water bottle, according to one aspect the disclosure.
Figure 1B:
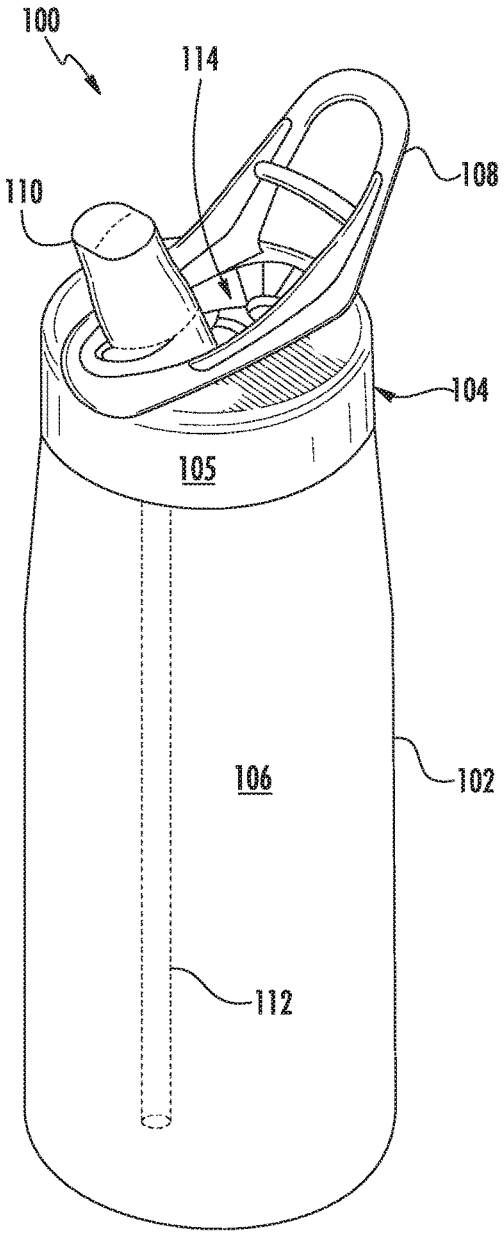

FIGS. 1A and 1B are schematic perspective views of a water bottle 100, according to one aspect the disclosure. The water bottle 100 includes a container body 102 and a lid 104. The container body 102 is formed from a plastic, aluminum, or other materials configured to hold liquids in an internal volume 106 thereof. The container body 102 may have a generally cylindrical shape, although other shapes and contours are contemplated. It is contemplated that fluids or beverages other than water may be contained with the water bottle 100.

The lid 104 includes a lid body 105 and is configured to secure to an upper end of the container body 102 and form a fluid-tight seal. The lid 104 may secure to the container body 102 by a threaded connection formed on an internal surface of the lid body 105, by a snap seal, by an interference fit, or the like. The lid 104 optionally includes a loop 108 to facilitating twisting of the lid 104 on a threaded connection, and to facilitate carrying or tethering of the water bottle 100. The lid 104 also includes an actuatable mouthpiece 110 positioned on an upper surface of the lid body 105. The mouthpiece 110 is actuatable, e.g., pivotable, from a closed position (shown in FIG. 1A) to an open position (shown in FIG. 1B). In the open position, the mouthpiece 110 extends away from the lid body 105 to provide a user access to the mouthpiece 110, and while in the closed position, the mouthpiece 110 is disposed downward against an upper surface of the lid body 105. In the closed positioned, the mouthpiece 110 may be positioned in a recess 114 so that the mouthpiece 110 is unobtrusive.

In the open position, the mouthpiece 110 is in fluid communication with a straw 112 that extends into the internal volume 106. Biting and/or suction applied to the mouthpiece 110 facilitates consumption of a liquid disposed in the internal volume 106 by providing liquid through the straw 112 and the mouthpiece 110 to a consumer. Actuation of the mouthpiece 110 into the closed positioned prohibits fluid flow from the straw 112 through the mouthpiece 110. In one example, a portion of the mouthpiece 110 physically blocks or otherwise seals an upper end of the straw 112 to prevent fluid flow into the mouthpiece 110.

Figure 2A:
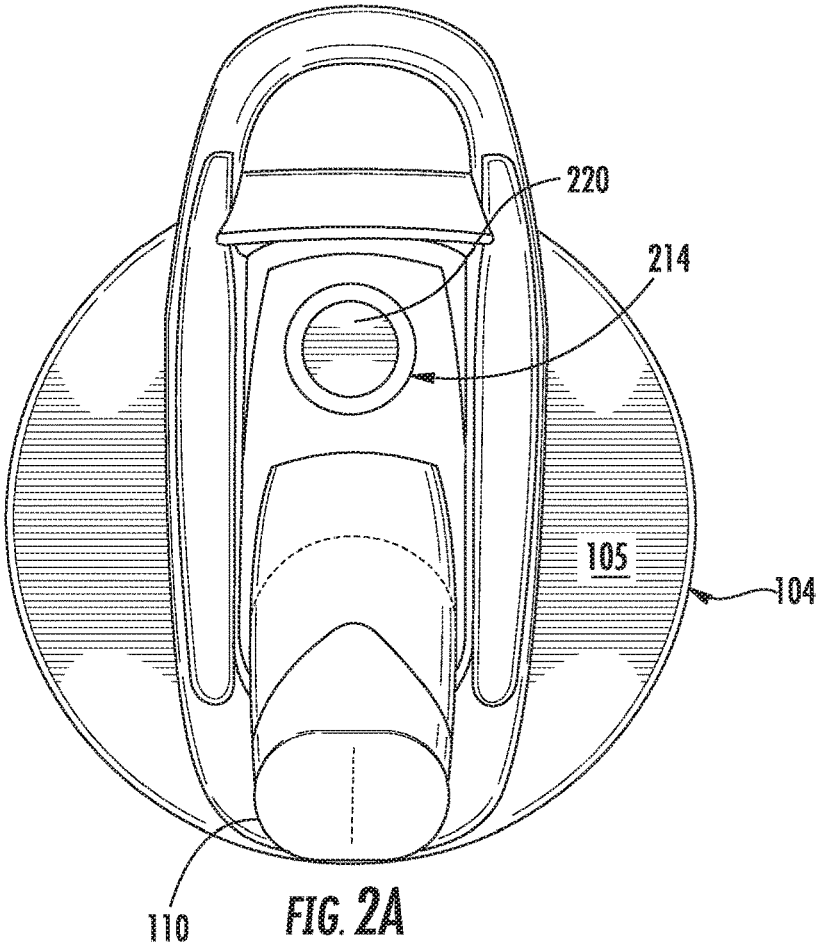
FIG. 2A is a schematic plan view of a lid, according to one aspect of the disclosure.
Figure 2B:
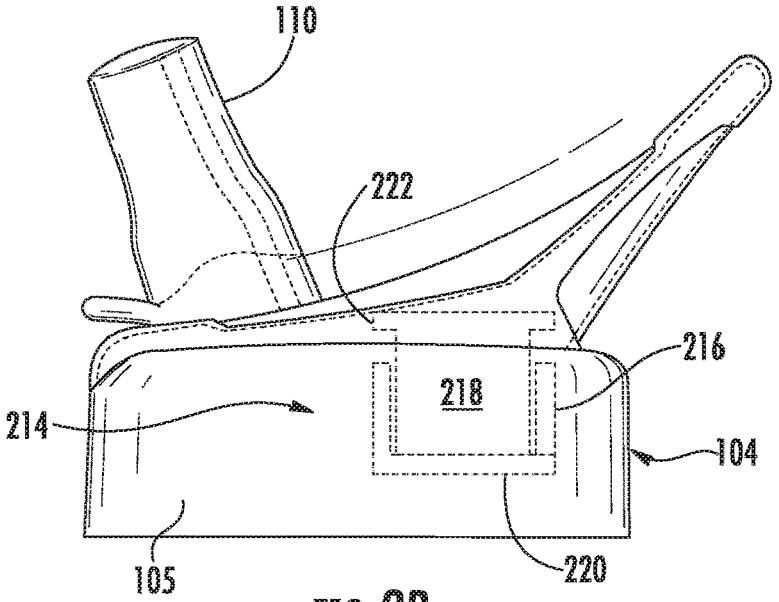
FIGS. 2B and 2C are schematic side views of a lid, according to one aspect of the disclosure.

FIG. 2A is a schematic plan view of a lid 104, according to one aspect of the disclosure. FIG. 2B is a schematic side view of the lid 104. The lid 104 includes a valve 214 position in an opening formed through an upper surface of the lid body 105. The valve 214 is positioned adjacent to and laterally spaced from the mouthpiece 110, e.g., the valve 214 is located at a location on the lid body 105 other than the location of the mouthpiece 110. Thus, the valve 214 is a separate valve than any valve which may be included in the mouthpiece 110 that prevents flow through the mouthpiece 110. In the illustrated example, the valve 214 is located within the recess 114. In one example, the valve 214 may be partially or completely covered by the mouthpiece 110 when the mouthpiece 110 is in the closed position. When the mouthpiece 110 is in the open position, as illustrated, the valve 214 is exposed.

The valve 214 may be a flutter valve, a flapper valve, a plunger valve, or a similar type of valve. The valve 214, as illustrated in the embodiment of FIG. 2B, is a flapper valve. The valve 214 includes a cylindrical housing 216 that is fixed relative to the lid 214. A cylindrical engagement member 218 is positioned concentrically within the cylindrical housing 216 and axially movable relative thereto. A flapper 220 is disposed at a lower end of the cylindrical housing 216 and is biased into a closed position, as illustrated in FIG. 2B. The valve 214 allows liquid movement unidirectionally, e.g., one way, into a water bottle. In the normal state of the valve 214, the valve 214 is closed and prevents liquid from exiting a water bottle. When the valve 214 is centrally located in the recess 114 (shown in FIG. 1A), the mouthpiece 110 acts as a secondary seal of the valve 214 when the mouthpiece 110 is folded down into the recess 114 (e.g., the closed position). In such a manner, fluid is prevented from escaping the water bottle even if the valve 214 is defective.

Figure 2C:
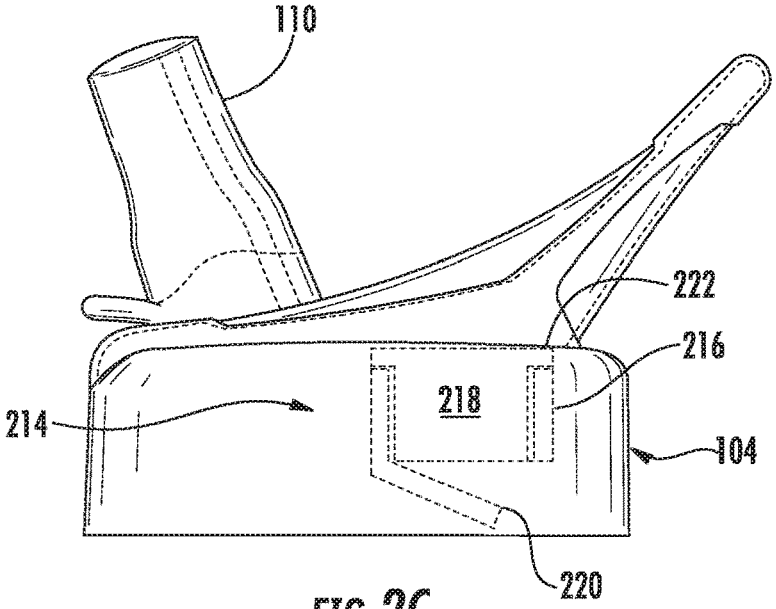

A lower end of the cylindrical engagement member 218 is in contact with the flapper 220 of the valve 214 and is biased upward by the flapper 220. An upper end of the cylindrical engagement member includes a flared portion 222 having an increased outer diameter to increase surface area and facilitate engagement with a fluid source, such as a faucet, spout, or spigot. The flared portion 22 may also have a larger shape than illustrated to function as a touch point where a user can manually depress the cylindrical engagement member 218 (thereby actuating the valve 214) without blocking fluid from entering the valve 214. Upon engagement with a fluid source, the cylindrical engagement member 218 is actuated downward toward the flapper 220. In response, the flapper 220 pivots to an open position, as shown in FIG. 2C. In the open position, the flapper 220 allows fluid to travel therethrough, and fill a water bottle, such as water bottle 100 (shown in FIG. 1). Travel of the cylindrical engagement member 218 may be limited by engagement of the flared portion 222 with an upper end of the cylindrical housing 216 and/or with engagement of an upper surface of the lid body 105. Upon disengagement with a fluid source or removal of manual actuation, the flapper 220 returns to the closed position and actuates the cylindrical engagement member 218 into an upward position (shown in FIG. 2B). As such, the flapper 220 is generally biased into the closed position, and is configured to return to the closed position upon removal of engagement with the fluid source.

The cylindrical engagement member 218 may be secured to the cylindrical housing 216 via a flexible connection, an interference fit, and the like. In one example, one or more posts or other features (not shown) extending radially from an outer sidewall of the cylindrical engagement member 218 may correspondingly engage a recess or track formed in an inner wall of the cylindrical housing 216. The recess or track may be axially disposed such that the post or other feature travels in the recess or track and is maintained in the recess or track to facilitate coupling of the cylindrical engagement member 218 and the cylindrical housing 216.

In another example, the cylindrical housing 216 may include two axially-spaced rings (or other raised features) formed on an inner wall of the cylindrical housing 216 and extending radially inward. The cylindrical engagement member 218 may include a single ring of material extending radially outward from an outer surface thereof. The ring of the cylindrical engagement member 218 may be positioned between the two rings formed on the inner wall of the cylindrical housing 216. In such a configuration, the two rings of the cylindrical housing 216 function as stops relative to the ring of the cylindrical engagement member 218 as the cylindrical engagement member 218 moves axially. In addition, the two rings (or other raised features) of the cylindrical housing 216 facilitate retention of the cylindrical engagement member 218. In another embodiment, the cylindrical engagement member 218 may be spring loaded to maintain the cylindrical engagement 218 in place. In such an example, the cylindrical engagement member 218 may be biased into an upward or raised position.

In some examples the cylindrical engagement member 218, the cylindrical housing 216 and the flapper 220 are formed from a flexible material, such as rubber, to facilitate actuation of the flapper 220 of the valve 214. In another example, the cylindrical housing 216 is formed from a rigid material, such as plastic.

Referring back to FIG. 2B, because the flapper 220 is biased into the closed position, fluid is generally prohibited from the escaping outward from a water bottle 100 (See FIG. 1) when the lid 104 is secured thereto. Even if the orientation of a water bottle is changed, the flapper 220 remains sealed against the cylindrical housing 216 and/or the cylindrical engagement member 218, preventing fluid flow therethrough. In fact, in some circumstances, such an up-side-down water bottle, it is contemplated that pressure applied by fluid to the flapper 220 may further facilitate sealing.

Figure 2D:
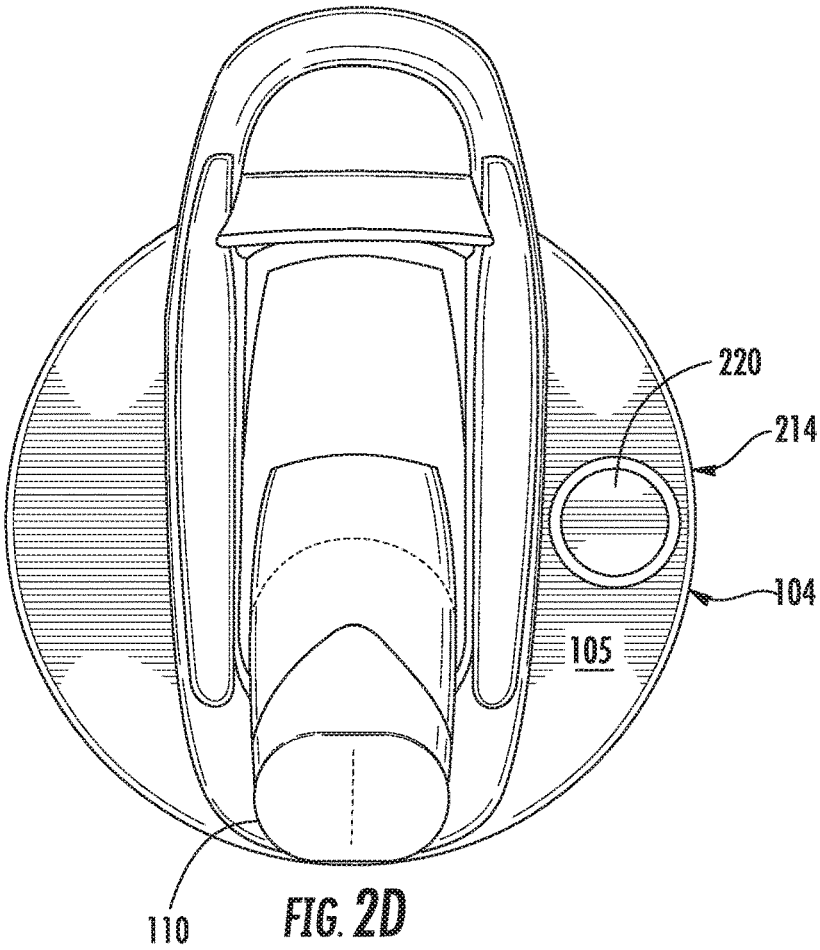
FIGS. 2D and 2E are schematic side views of a lid, according to another aspect of the disclosure.
Figure 2E:
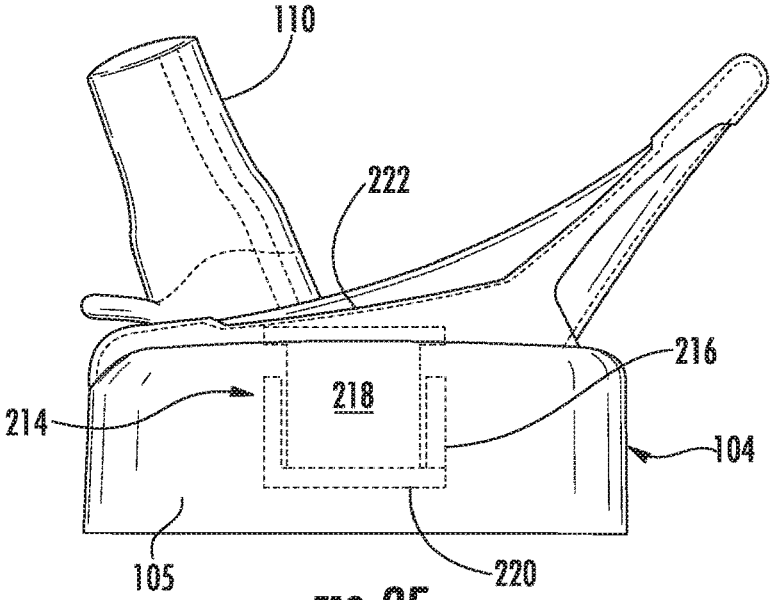

While FIGS. 2A and 2B illustrate one type of valve 214, it is contemplated that other securing mechanisms may be used to provide a selective water tight seal. For example, a flip cap may be used. In such an example, a user may manually operate the flip cap to open and close an orifice to allow filling of a water bottle. In addition, it is contemplated that the valve 214 may be positioned in alternative locations on the lid body 105. FIGS. 2D and 2E illustrate an alternative location of the valve 214. As illustrated in FIGS. 2D and 2E, the valve 214 is positioned near an edge of the lid body 105, and is not disposed in the travel path of the mouthpiece 110. In one example, when the valve 214 is positioned as shown in FIGS. 2D and 2E, a secondary securing mechanism (such as a flip cap) may be positioned over the valve 214, thus redundantly sealing the valve 214 and preventing inadvertent leakage from the valve 214.

In addition, while the cylindrical housing 216 and the cylindrical engagement member are shown and described as having a cylindrical shape, it is to be noted that other shapes are also contemplated.

Figure 3:
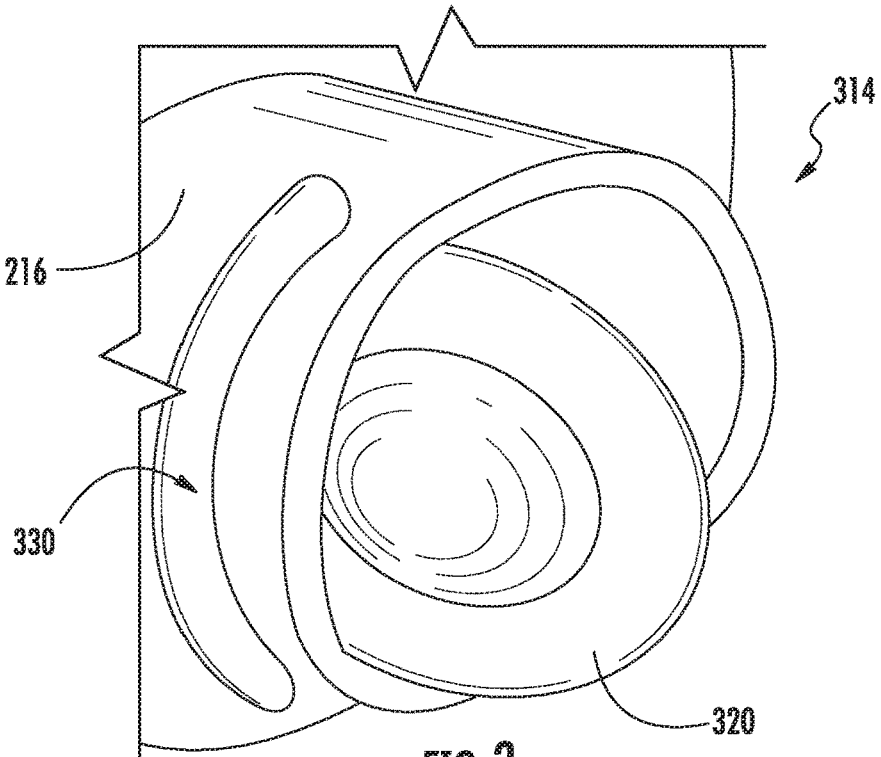
FIG. 3 is a schematic perspective view of a valve, according to another aspect of the disclosure.

FIG. 3 is a schematic view of a valve 314, according to another aspect of the disclosure. FIG. 3 illustrates a flapper valve 314, which may be used in place of valve 214. Valve 314 is similar to the valve 214 except the flapper 320 includes a coupling 330 to facilitate connection to the cylindrical housing 216. The coupling 330 includes a semi-circular section of material coupled to a radially outward edge of the flapper 320. The semi-circular section of the coupling 330 of material is positioned adjacent an outer sidewall of the cylindrical housing 216, while an actuatable disk portion of the flapper 320 is positioned within the circular housing 216. The actuatable disk portion of the flapper 320 is connected to the coupling 330 through an opening (not show) formed in the sidewall of the cylindrical housing 216. The coupling 330 is sized to prevent dislocation of the flapper 320, but is sufficient flexible to allow actuation of the flapper 320. In one example, the flapper 320 may seal against a shoulder disposed on an interior sidewall of the cylindrical housing 216.

Figure 4A:
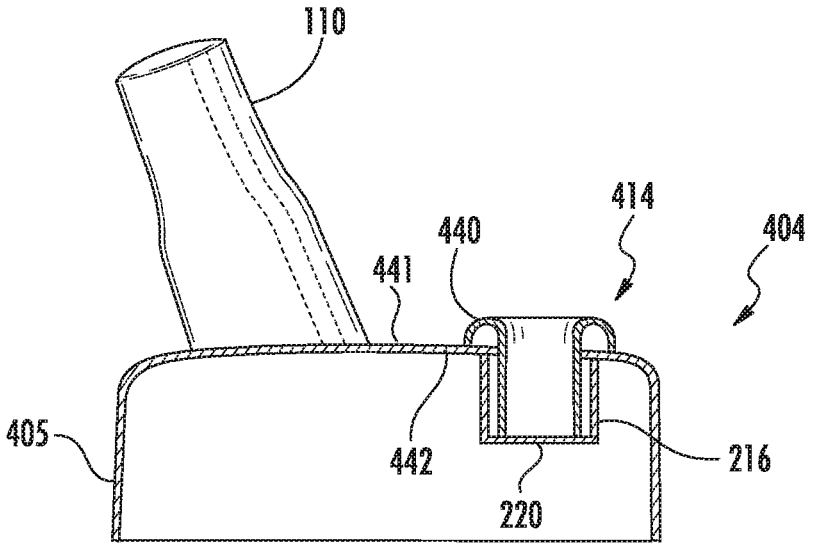
FIGS. 4A and 4B are schematic sectional views of a lid, according to other aspects of the disclosure.
Figure 4B:
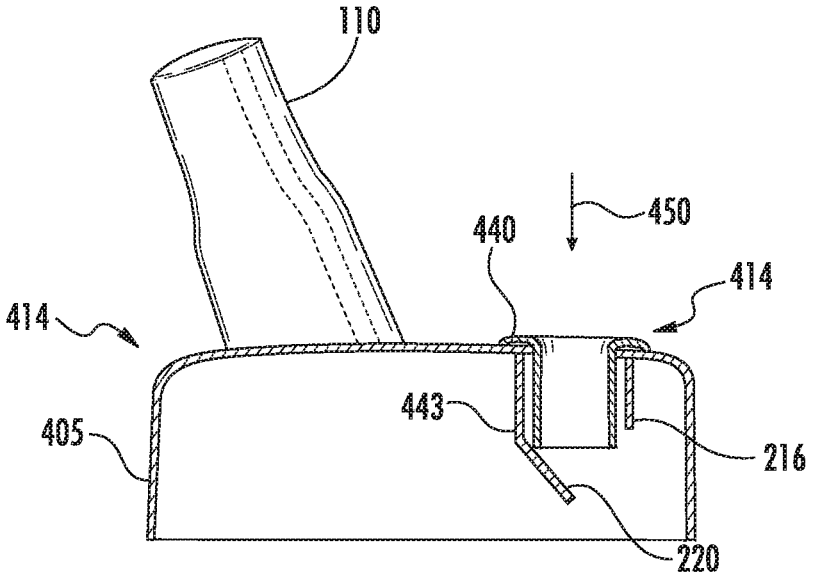

FIGS. 4A and 4B are schematic sectional views of a lid 404, according to other aspects of the disclosure. The lid 404 is similar to the lid 104, and may be used in place thereof. The lid 404 excludes an optional loop 108 (shown in FIGS. 1A and 1B) for clarity. However, it is contemplated that the lid may include a loop 108.

The lid 404 includes a lid body 405 having a valve 414 disposed therein. The valve 414 is disposed in an opening formed in an upper surface 441 the lid body 405, adjacent a mouthpiece 110. The valve includes a plunger 440, a cylindrical housing 216, and a flapper 220. The cylindrical housing 216 is coupled to an underside 442 of the lid 104, and the flapper 220 is coupled to the distal end 443 (shown in FIG. 4B) of the cylindrical housing 216. The plunger 440 is operable to actuate the flapper 220, thereby opening and closing the valve 414. The valve 414 is secured to the upper surface 441 of the lid body 405 at a first end thereof, and rolls over downward beneath the upper surface of the lid 404 adjacent cylindrical housing 216 and into contact with the flapper 220. Upon application of downward pressure (as shown by arrow 450), such as by engagement with a faucet or spout, the plunger 440 is directed downward in a flexing or rolling manner such that the flapper 220 is deflected away from the cylindrical housing 216, thereby opening the valve 414 and allowing fluid to pass therethrough. It is contemplated that the plunger 440 engages the faucet or spout at the rolled portion of the plunger 440, thereby increasing the surface area to contact the faucet or spout.

The compressed plunger 440 is illustrated in FIG. 4B. The travel distance of the plunger 440 may be limited by contact with the upper surface 441 of the lid body 405, or by a deflection limit of the flapper 220. Upon removal of the downward pressure applied to the plunger 440, the flapper 220 and the plunger 440 return to the closed position, illustrated in FIG. 4A.

Benefits of the present disclosure include the ability to fill a water bottle without removing the lid. Because the lid need not be removed, simple, one-handed filling of a water bottle is provided. Additionally, individuals with dexterity issues can also more easily fill water bottles using the disclosed lid.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While the foregoing is directed to embodiments of the present disclosure, other and further embodiments of the disclosure may be devised without departing from the basic scope thereof, and the scope thereof is determined by the claims that follow.

What is claimed is:

1. A lid for a bottle, comprising:
- a lid body having an upper surface and a lower surface;
- a mouthpiece coupled to the upper surface of the lid body; and
- a valve formed in the lid body and laterally spaced from the mouthpiece, the valve extending below the lower surface of the lid body and comprising:
  - a flapper;
  - a cylindrical housing; and
  - a cylindrical engagement member disposed within the cylindrical housing that when engaged causes the flapper to pivot open and selectively allow fluid flow therethrough.

2. The water bottle lid of claim 1, wherein the flapper is biased to return to a closed position.

3. The water bottle lid of claim 1, further comprising a straw coupled to the mouthpiece.

4. The water bottle lid of claim 1, wherein the mouthpiece is actuatable to cover and to expose the valve.

5. The water bottle lid of claim 1, wherein the valve is formed in a recess off-centered on the upper surface of the lid body.

6. The water bottle lid of claim 1, wherein the cylindrical housing and the cylindrical engagement member are positioned concentrically with respect to each other.

7. The water bottle lid of claim 1, wherein the cylindrical engagement member comprises an upper portion and a lower portion, the lower portion having an outer diameter greater than an outer diameter of the lower portion.

8. A water bottle, comprising:
- a container body; and
- a lid configured to be secured to the container body, the lid comprising:
  - a lid body having an upper surface and a lower surface;
  - a mouthpiece coupled to the upper surface of the lid body;
- a valve formed in the lid body and laterally spaced form the mouthpiece, the valve extending below the lower surface of the lid body and comprising:
  - a flapper;
  - a cylindrical engagement housing; and
  - a cylindrical engagement member disposed in the cylindrical housing that when engaged causes the flapper to pivot open and selectively allow fluid flow therethrough.

9. The water bottle of claim 8, wherein the flapper is biased to return to a closed position.

10. The water bottle of claim 8, further comprising a straw coupled to the mouthpiece.

11. The water bottle of claim 8, wherein the mouthpiece is actuatable to cover and to expose the valve.

12. The water bottle of claim 8, wherein the valve is formed in a recess off-centered on the upper surface of the lid body.

13. The water bottle of claim 8, wherein the cylindrical housing and the cylindrical engagement member are positioned concentrically with respect to the cylindrical housing.

14. The water bottle of claim 8, wherein the lid secures to the container body via threaded connection.

15. A water bottle, comprising:

a container body; and a lid configured to be secured to the container body by a threaded connection, the lid comprising:

a lid body;

a mouthpiece coupled to the lid body;

a capless valve formed in the lid body and laterally spaced from the mouthpiece, the valve comprising:

a flapper;

a cylindrical housing; and a cylindrical engagement member disposed within the cylindrical housing and actuatable to selectively allow fluid flow therethrough when engaged by a fluid source; and a straw coupled to the mouthpiece and extendable into the container body when the lid is secured to the container body.

* * * * *